US006143484A

United States Patent [19]

Schroeder et al.

[11] Patent Number: 6,143,484

[45] Date of Patent: Nov. 7, 2000

[54] METHOD FOR STABILIZING PHOTOGRAPHIC DISPERSIONS IN MELTS CONTAINING FINE GRAIN SILVER HALIDE

[75] Inventors: Kurt M. Schroeder, Rochester; Jayme D. Ribeiro, Pittsford; Gary L. Slater, Rochester; Timothy J. Hubert, Hilton, all of N.Y.

[73] Assignee: Eastman Kodak Company, Rochester, N.Y.

[21] Appl. No.: 09/306,000

[22] Filed: May 6, 1999

[51] Int. Cl.[7] ..... G03C 1/815; G03C 1/015

[52] U.S. Cl. ..... 430/512; 430/568; 430/569; 430/631; 430/636; 430/637

[58] Field of Search ..... 430/512, 631, 430/636, 637, 568, 569

[56] References Cited

U.S. PATENT DOCUMENTS

| | | | |
|---|---|---|---|
| 2,739,888 | 3/1956 | Sawdey | 430/512 |
| 3,215,530 | 11/1965 | Riebel et al. | 430/512 |
| 3,352,681 | 11/1967 | Ohi et al. | 430/512 |
| 3,661,592 | 5/1972 | Philippaerts et al. | 430/569 |
| 3,704,130 | 11/1972 | Pollet et al. | 430/569 |
| 3,707,375 | 12/1972 | Reiichi Ohi et al. | 430/517 |
| 4,199,363 | 4/1980 | Chen | 430/512 |
| 4,247,627 | 1/1981 | Chen | 430/512 |
| 4,304,769 | 12/1981 | Chen . | |
| 4,368,258 | 1/1983 | Fujiwhara et al. | 430/512 |
| 5,196,300 | 3/1993 | Urabe et al. | 430/568 |
| 5,300,394 | 4/1994 | Miller et al. | 430/512 |
| 5,411,844 | 5/1995 | Orem | 430/631 |
| 5,468,604 | 11/1995 | Zengerle et al. | 430/631 |
| 5,523,200 | 6/1996 | Hahm et al. | 430/631 |
| 5,536,628 | 7/1996 | Wang et al. | 430/961 |
| 5,593,818 | 1/1997 | Kawamoto | 430/512 |
| 5,594,047 | 1/1997 | Nielsen et al. | 430/512 |
| 5,976,775 | 11/1999 | Ishii | 430/512 |

OTHER PUBLICATIONS

T.H. James, "The Theory of the Photographic Process", 4$^{th}$ Edition, Macmillan Publishing Co. N.Y. pp. 291–334.

*Primary Examiner*—Richard L. Schilling
*Attorney, Agent, or Firm*—Doreen M. Wells; Carl R. Ruoff

[57] ABSTRACT

The present invention is a method for stabilizing a photographic coating melt. The photographic melt includes an aqueous medium and a dispersed liquid organic phase containing an ultraviolet ray absorbing compound, and an emulsion containing silver halide particles having an average equivalent circular diameter of from 0.03 to 0.10 microns. The photographically useful ultraviolet ray absorber compound is soluble in a liquid organic phase and substantially insoluble in water. The method includes the step of adding to the emulsion containing silver halide particles a sufficient amount of surfactant to passify surfaces of the silver halide particles. The present invention is also a method of preparing a photographic coating melt. A dispersion is prepared which includes an aqueous medium, a dispersed liquid organic phase and an ultraviolet ray absorber compound wherein the ultraviolet ray absorber compound is soluble in the dispersed liquid organic phase and substantially insoluble in water. An emulsion is prepared containing silver halide particles having an average equivalent circular diameter of from 0.03 to 0.10 microns. A sufficient amount of surfactant to passify surfaces of the silver halide particles is added to the emulsion. The dispersion and emulsion are combined to form the photographic coating melt.

19 Claims, No Drawings

METHOD FOR STABILIZING PHOTOGRAPHIC DISPERSIONS IN MELTS CONTAINING FINE GRAIN SILVER HALIDE

FIELD OF THE INVENTION

This invention relates to a method of stabilizing a photographic dispersion in the presence of a fine grain silver halide particle, the resulting stabilized dispersion and photographic elements prepared therefrom.

BACKGROUND OF THE INVENTION

It is conventional to incorporate fine grain silver halide particles, commonly known as Lippmann emulsion, in an image element to scavenge process seasoning fragments. The level of Lippmann emulsion can effect the photographic elements overall sensitometric properties such as contrast and interimage. As for the conventional arts, a "Lippmann" emulsion, having a grain size of 0.050 $\mu$m, is disclosed as a silver bromide fine grain emulsion, e.g., in T. H. James, The Theory of the Photographic Process, 4th Ed. Lippmann emulsions typically have an average size between about 0.030 and about 0.10 $\mu$m. Methods for incorporating fine grain silver bromide and Lippmann emulsion into a photographic element have been described in U.S. Pat. Nos. 3,661,592; 3,704,130; 5,196,300 and 5,523,200.

It is also well known in the photographic art to incorporate photographically useful compounds, for example, ultraviolet ray absorbers, which are dispersed in an aqueous medium containing a hydrophilic colloid, such as gelatin. The ultraviolet absorber compound may be a liquid which may be directly dispersed into the aqueous medium or it may be a solid or liquid predissolved in an organic solvent. Typically, the photgraphically useful compound is dissolved in a permanent organic solvent or in combination with an auxiliary organic solvent which is later removed by evaporation, washing or dialysis. The photographically useful compound or solution thereof is mixed with the aqueous medium, which may optionally contain a surfactant, under conditions of high shear or turbulence to break the organic phase into submicronic particles. Different methods for incorporating an ultraviolet ray absorber into a photographic element have been disclosed in U.S. Pat. Nos. 2,739,888; 3,215,530; 3,352,681; and 3,707,375.

Another method of incorporating an ultraviolet ray absorber into a photographic element is by loading such an absorber into pre-formed latex particles as described in U.S. Pat. Nos. 4,199,363; 4,304,769; 4,247,627; and 4,368,258. In this process, a hydrophobe, such as an ultraviolet ray absorber, is first dissolved in a water miscible organic solvent and then blended with an aqueous latex. Alternatively, U.S. Pat. No 5,536,628 describes a process for incorporating absorbers into a pre-formed latex polymer particle. In the process a polymer latex of known solids is heated with stirring to 70 to 80° C. The absorbing compound is heated until it reaches its liquid state and is mixed with the polymer latex at high shear to generate an emulsion. The emulsion is then passed through a high energy homogenizer at least once to form an absorber impregnated latex polymer dispersion.

The resulting ultraviolet absorber dispersion can be coated onto a support or incorporated into a silver halide emulsion or other photographic composition which is then coated onto a support. It is well known to incorporate photographic dispersions of ultraviolet absorber compounds into a composition containing Lippmann emulsion. Such a composition is commonly referred to as a melt and can also contain other components such as, acids or bases to control pH, coating surfactants, thickeners, salt solutions; and the like. During or just prior to the coating step, the melt may be heated to about 45° C. and maintained at that temperature for up to 24 hours. It has been noted that in certain instances the dispersion particles containing the ultraviolet absorber compounds undergo an undesirable increase in particle size when Lippmann emulsion is present in the coating composition. If the particle growth is severe enough, extremely large particles (greater than 3 $\mu$m in diameter) can be formed. Particles in this size range are undesirable in manufacturing since they can lead to filter plugging during coating operations. These particles may be visible in magnified prints or projections representing a physical defect in the coated photographic product. In addition, the large droplets may reach sizes which are larger than the thickness of the coated layer and may degrade the mechanical properties of the layer such as scratch resistance, pressure sensitivity, adhesion; and the like.

An attempt to slow the particle growth in photographic dispersions is disclosed in U.S. Pat. No. 5,468,604 to Zengerle et al. Zengerle et al. disclose a method for stabilizing a photographic dispersion by addition to the dispersed phase of a hydrophobic, photographically inert compound which has a $\log P_{(cake)}$ greater than 9 and does not solidify or gel the dispersed phase. While this method does slow particle growth in the photographic dispersion, it does not eliminate the formation of large droplets in coating compositions containing photographic dispersions of ultraviolet absorbers and fine grain silver halide particles.

Therefore, the problem solved by the present invention is to inhibit large particle formation in a photographic dispersion during the presence of a fine grain silver halide particle in the manufacturing process of an image element.

SUMMARY OF THE INVENTION

The present invention is a method for stabilizing a photographic coating melt. The photographic melt includes an aqueous medium and a dispersed liquid organic phase containing an ultraviolet ray absorbing compound, and an emulsion containing silver halide particles having an average equivalent circular diameter of from 0.03 to 0.10 microns. The photographically useful ultraviolet ray absorber compound is soluble in a liquid organic phase and substantially insoluble in water. The method includes the step of adding to the emulsion containing silver halide particles a sufficient amount of surfactant to passify surfaces of the silver halide particles. The present invention is also a method of preparing a photographic coating melt. A dispersion is prepared which includes an aqueous medium, a dispersed liquid organic phase and an ultraviolet ray absorber compound wherein the ultraviolet ray absorber compound is soluble in the dispersed liquid organic phase and substantially insoluble in water. An emulsion is prepared containing silver halide particles having an average equivalent circular diameter of from 0.03 to 0.10 microns. A sufficient amount of surfactant to passify surfaces of the silver halide particles is added to the emulsion. The dispersion and emulsion are combined to form the photographic coating melt.

DETAILED DESCRIPTION OF THE INVENTION

We have found that certain surfactants can be added to a Lippmann emulsion prior to combination with a photographic dispersion of an ultraviolet absorber compound in a melt composition which greatly inhibits an undesired growth in the photographic dispersion subject to large droplet formation. The surfactants which inhibit large droplet formation are from the general class of anionic or nonionic alkyl or aryl surfactants. While such surfactants are known in the photographic art as dispersing and coating aids, as described in U.S. Pat. Nos. 5,300,394 and 5,411,844, their use as particle growth inhibitors involving fine grain silver halide and photographic dispersion coating formulations is not described or suggested.

One aspect of this invention comprises a method for stabilizing a photographic dispersion of a photographically useful compound which is subject to large droplet formation when added to an aqueous coating composition which contains a fine grain silver halide emulsion containing an anionic or nonionic surfactant. The resulting stabilized photographic dispersion and coating composition can be used in preparing a photographic element.

The photographic dispersion of this invention comprises an ultraviolet absorber compound which may be subject to undesirable particle growth. The ultraviolet absorber compound may be represented by the general formula I.

(I)

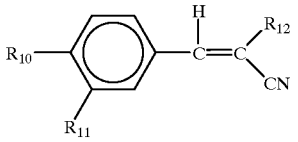

The following list represents limited examples of compounds which might be subject to particle growth given by formula I.

| Compound No. | $R_{10}$ | $R_{11}$ | $R_{12}$ |
|---|---|---|---|
| UV-1 | $CH_3$ | H | $CO_2CH_7$ |
| UV-2 | $OCH_3$ | H | $CO_2CH_7$ |
| UV-3 | $OCH_3$ | H | $CO_5CH_{11}$ |
| UV-4 | $OCH_3$ | H | 2-ethylhexyl |
| UV-5 | $OCH_3$ | H | $CO_2C_8H_{17}$ |
| UV-6 | $OCH_3$ | H | $CO_2C_9H_{19}$ |
| UV-7 | $OCH_3$ | H | $SO_2C_3H_7$ |
| UV-8 | $OCH_3$ | H | $SO_2C_4H9$ |
| UV-9 | $OCH_3$ | H | $SO_2C_5H_{11}$ |
| UV-10 | $OCH_3$ | H | $SO_2C_6H_{13}$ |
| UV-11 | $OCH_3$ | H | $SO_2C_8H_{17}$ |
| UV-12 | $OCH_3$ | H | $SO_2CH_3$ |
| UV-13 | $OC_3H_7$ | H | $CO_2C_8H_{17}$ |
| UV-14 | $OC_3H_7$ | H | 2-ethylhexyl |
| UV-15 | $OC_3H_7$ | H | $CO_2C_9H_{19}$ |
| UV-16 | $OC_3H_7$ | H | $SO_2CH_3$ |
| UV-17 | $OC_3H_7$ | H | $SO_2C_3H_7$ |
| UV-18 | $OC_3H_7$ | H | $SO_2C_4H_9$ |
| UV-19 | $OC_3H_7$ | H | $SO_2C_6H_{13}$ |
| UV-20 | $OC_3H_7$ | H | $SO_2C_8H_{17}$ |
| UV-21 | $OC_2H_5$ | $OCH_3$ | $CO_2C_2H_5$ |
| UV-22 | $OC_4H_9$ | $OCH_3$ | $CO_2C_2H_5$ |
| UV-23 | $OC_6H_5$ | $OCH_3$ | $CO_2C_2H_4OH$ |
| UV-24 | $OCH_2C_6H_5$ | OH | $CO_2C_2H_5$ |
| UV-25 | $OCH_2OCO_2C_2H_5$ | $OCH_3$ | $CONHC_6H_5$ |
| UV-26 | $OC_2H_4OCOCH_3$ | $OCH_3$ | $CONHCH_2C_6H_5$ |

The ultraviolet absorber compound of this invention may also be represented by formula II.

(II)

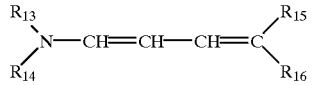

where $R_{13}$ and $R_{14}$, which may be the same or different, each represents a hydrogen atom, an alkyl group, an aryl group, $R_{15}$ and $R_{16}$ each represents a cyano group, $COOR_{17}$, $COR_{17}$, $SOR_{17}$, where $R_{17}$ represents an alkyl group, or an aryl group.

The ultraviolet absorber compound of this invention may be dissolved in a permanent and/or auxiliary solvent dispersed in an aqueous medium. The permanent solvent, if present, remains in the photographic dispersion. The use of permanent solvents to disperse water insoluble photographically useful compounds in an aqueous medium are well known. The permanent solvent of the present invention can be chosen from a broad class of compounds including: alkyl phthalates, aryl phthalates, alkyl amides, phosphates, phenols, alcohols, sulfoxides, esters, hydrocarbons, alkyl halides, and the like. Permanent solvents applicable to dispersions of photographically useful compounds are, for example:

di ethyl phthalate
di butyl phthalate
di pentyl phthalate
di isoamyl phthalate
di benzyl phthalate
di methoxyethyl phthalate
di butoxyethyl phthalate
acetyl tributyl citrate
tributyl citrate
triethyl citrate
di methyl sebacate
di ethyl sebacate
1,4-cyclohexylenedimethylene bis(2-ethylhexanaoate)
bis-ethylhexyl sulfoxide
triphenylphosphate
tricresylphosphate
trihexylphosphate
n-Hexylphenylcarbinol
2-(p-tert, butylphenoxy)-ethanol
Acetyl n-butyl aniline
N-n-amyl succinimide
N,N-di-propyl dodecanamide
di-tert amyl phenol
phenoxy toluene
ethylhexyl hydroxy benzoate
ethylhexyltoluene sulfonamide
undecyl alcohol
butyl methoxy benzoate
butyl phthalylbutyl glycollate
N,N'-di-n-butyl urea and the like.

The ultraviolet absorber dispersion of this invention may also be comprised of a hydrophobic, photographically inert compound with a $\log P_{(cake)}$ greater than 9. Representative compounds from this class of materials are, for example:

hexadecane
bis (2-ethylhexyl)azelate
tri (2-ethylhexyl) phosphate
trioctylphosphine oxide
dinonyl phthalate
didecyl phthalate
didodecyl phthalate 3-(4-hydroxy-3,5-di-t-butylphenyl)propionic acid octadecyl ester trioctyl amine The ultraviolet absorber compound of this invention may optionally be contained in a polymer particle. The polymer particles containing the ultraviolet ray absorber in the present invention are prepared by emulsion polymerization of radically polymerizable monomers. Examples of usable monomers include, an ester or an amide derived from an acrylic acid or α-alkylacrylic acid such as methacrylic acid (for example, methyl acrylate, methyl methacrylate, ethyl acrylate, ethyl methacrylate, hydroxyethyl methacrylate, acetoacetoxyethyl methacrylate, butoxyethyl acrylate, methoxypolyethylene glycol methacrylate, propyl acrylate, butyl acrylate, butyl methacrylate, ethylhexyl acrylate, cyclohexyl methacrylate, hexyl acrylate, octyl methacrylate, lauryl methacrylate, acrylamide, methacrylamide, methyl methacrylamide, cyclohexyl acrylamide, butyl acrylamide, N,N-dimethyl acrylamide, butyl methacrylamide, etc.), a vinyl ester (for example, vinyl acetate, vinyl propionate, vinyl laurate, vinyl butyrate, vinyl caproate, vinyl benzoate, etc.), a vinyl ether (for example, vinyl methyl ether, vinyl butyl ether, etc.), a vinyl nitrile (for example, acrylonitrile, methacrylonitrile, etc.) , a styrenic (for example, styrene, α-methyl styrene, hydroxy styrene, chlorostyrene, methyl styrene), an ester of maleic acid, N-vinyl-2-pyrrolidone, vinyl chloride, vinylidene chloride, vinyl pyridine, and the like.

The polymer particles containing the ultraviolet ray absorber in the present invention may alternatively be composed of a polyurethane. Polyols useful for the preparation of polyurethane dispersion of the present invention include polyester polyol prepared from a diol (e.g. ethylene glycol, butylene glycol, neopentyl glycol, hexane diol or mixtures of any of the above) and a dicarboxylic acid or an anhydride (succinic acid, adipic acid, suberic acid, azelaic acid, sebacic acid, phthalic acid, isophthalic acid, maleic acid and anhydrides of these acids), polylactones from lactones such as caprolactone reacted with a diol, polyethers such as polypropylene glycols, and hydroxyl terminated polyacrylics prepared by addition polymerization of acrylic esters such as the aforementioned alkyl acrylate or methacrylates with ethylenically unsaturated monomers containing functional groups such as carboxyl, hydroxyl, cyano groups and/or glycidyl groups.

Diisocyanate that can be used are as follows: toulene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cycopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'diisocyanatodiphenyl ether, tetramethyl xylene diisocyanate and the like.

Compounds that are reactive with the isocyanate groups and have a group capable of forming an anion are as follows: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like.

Suitable tertiary amines that are used to neutralize the acid and form an anionic group for water dispersability are trimethylamine, triethylamine, dimethylaniline, diethylaniline, triphenylamine and the like. Diamines suitable for chain extension of the polyurethane include ethylenediamine, diaminopropane, hexamethylene diamine, hydrazine, amnioethylethanolamine and the like.

Examples of commercially available polyurethane dispersions useful for the practice of the present invention include water-borne urethane acrylic copolymer dispersion "Neopac" as manufactured by Zeneca Resins, water-borne urethane polymer dispersion "NeoRez" as manufactured by Zeneca Resins, Witcobond aqueous urethane dispersions as manufactured by Witco Corporation, Bayhydrol polyurethane dispersions as manufactured by Bayer Corporation, Flexthane urethane dispersions as manufactured by Air Product, Sancure polyurethane dispersions as manufactured by BF Goodrich, and the like.

The Lippmann emulsion of this invention comprises a fine grain silver bromide emulsion having an average particle size of between about 0.03 μm and about 0.10 μm. The Lippmann emulsion may be stabilized in a hydrophillic binder, such as gelatin, and may also contain stabilizers such as tetraazaindene sodium salts, antifoamants and acid or base solutions. Typically, the Lippmann emulsion is ultrafiltered to an acceptably low conductivity to remove residual salts.

The surfactant of the present invention is added to the Lippmann emulsion prior to contact between the ultraviolet ray absorber dispersion and Lippmann emulsion in the preparation of the melt. The level of surfactant added to the Lippmann emulsion should be sufficient to passivate the surface area of the Lippmann emulsion and is therefore dependent on the amount of fine grain silver present in the photographic melt. The surfactant may be chosen from the general classes of aryl or alkyl anionics or nonionics. The compounds may be chosen from a wide variety of subclasses such as: sulfonates of napthalene, sulfosuccinimates, sulfosuccinates, sulfates and sulfonates of ethoxylated alcohols, ethoxylated alkyl phenols, diphenyl sulfonate derivatives and polyglycidols. Representative compounds are given below:

sodium dodecyl diphenyl ether disulfonate (Dowfax 2A1, Dow Chemical)

nonylphenoxypolyglycerol (Olin 10G, Olin Mathieson)

octylphenoxy polyethoxyethanol (Triton X-100, Rohm and Haas)

sodium octyl phenol poly (etheneoxy)sulfonate (Triton X-200, Rohm and Haas)

sodium dodecyl sulfate (SDS)

sodium napthalene sulfonates (Alkanol XC, Dupont)

A further aspect of this invention comprises a photographic element comprising a support and a layer prepared from a stabilized coating solution as described above. In preferred embodiments of this invention the photographic element comprises a plurality of layers, at least one of which is prepared a stabilized coating composition of this invention and at least one other of which comprises a photosensitive silver halide emulsion layer. Coating a photographic support with a photographic coating solution is well known and the coating compositions of this invention may applied to a support in any suitable process. Suitable methods are described, for example, in Research Disclosure 308119 (December 1989) section XV.

The following examples illustrate the use of a surfactant added to a fine grain silver halide particle to prevent the formation of large oil droplets in a photographic melt containing an ultraviolet ray absorbing compound dispersion.

EXAMPLE 1

An ultraviolet ray absorbing dispersion was prepared in the following way: 100.0 g of Type IV gelatin, together with 60 g of a 10% aqueous solution of Alkanol XC (Dupont), was dissolved in 693.4 g of water at 80° C. 37.5 g of anisylidene-n-propylcyanoacetate, 37.5 g of 3-di-n-hexylaminoallylidene-malonitrile, and 0.75 g of Irganox 1076 was dissolved in 52.5 g of tricresyl phosphate and added to the aqueous gelatin solution. The resulting mixture was pre-mixed for 2 minutes using a Tekmnar high shear mixer and passed through a Crepaco homogenizer one time at 5000 psi. The resulting dispersion, denoted as dispersion A, was chill set at 5° C. and stored for melt preparation.

A photographic melt used in silver halide color photographic materials was prepared by combining 28.9 g of the ultraviolet ray absorbing dispersion A, 32.5 g of a 14% Lippmann emulsion, having an average equivalent spherical diameter of 0.05 microns, dispersed in gelatin, 5.3 g of a 35% Type IV gelatin, 30.1 g of water, 1.7 g of a magnesium sulfate solution and 1.5 g of a sodium hydroxide solution. The resulting melt was heated to 45° C. and held for 7 hours under low shear mixing. The resulting photographic melt is referred to as melt A.

EXAMPLE 2

A Lippmann emulsion from Example 1 was treated with a surface active agent by heating 32.4 g Lippmann emulsion to 45° C. and adding 2.5 g of a 6.8% solution of TX-200 (Rohm and Haas) while mixing under low shear. The resulting Lippmann emulsion, referred to as Lippman emulsion B, was chill set at 5° C. and saved for melt preparation.

A photographic melt used in silver halide color photographic materials was prepared by combining 28.9 g of the ultraviolet ray absorbing dispersion A from Example 1, 34.9 g of Lippmann emulsion B, 5.3 g of a 35% Type IV gelatin, 27.7 g of water, 1.7 g of a magnesium sulfate solution and 1.5 g of a sodium hydroxide solution. The resulting melt was heated to 45° C. and held for 7 hours under low shear mixing. The resulting photographic melt is referred to as melt B.

EXAMPLE 3

A Lippmann emulsion from Example 1 was treated with a surface active agent by heating 32.4 g Lippmann emulsion to 45° C. and adding 5.0 g of a 3.4% solution of sodium dodecyl sulfate while mixing under low shear. The resulting Lippmann emulsion, referred to as Lippman emulsion C, was chill set at 5° C. and saved for melt preparation.

A photographic melt used in silver halide color photographic materials was prepared by combining 28.9 g of the ultraviolet ray absorbing dispersion A from Example 1, 37.4 g of Lippmann emulsion C, 5.3 g of a 35% Type IV gelatin, 25.2 g of water, 1.7 g of a magnesium sulfate solution and 1.5 g of a sodium hydroxide solution. The resulting melt was heated to 45° C. and held for 7 hours under low shear mixing. The resulting photographic melt is referred to as melt C.

EXAMPLE 4

A Lippmann emulsion from Example 1 was treated with a surface active agent by heating 32.4 g Lippmann emulsion to 45° C. and adding 1.7 g of a 10% solution of Olin 10G (Olin Mathieson) while mixing under low shear. The resulting Lippmann emulsion, referred to as Lippman emulsion D, was chill set at 5° C. and saved for melt preparation.

A photographic melt used in silver halide color photographic materials was prepared by combining 28.9 g of the ultraviolet ray absorbing dispersion A from Example 1, 34.1 g of Lippmann emulsion D, 5.3 g of a 35% Type IV gelatin, 28.5 g of water, 1.7 g of a magnesium sulfate solution and 1.5 g of a sodium hydroxide solution. The resulting melt was heated to 45° C. and held for 7 hours under low shear mixing. The resulting photographic melt is referred to as melt D.

EXAMPLE 5

A Lippmann emulsion from Example 1 was treated with a surface active agent by heating 32.4 g Lippmann emulsion to 45° C. and adding 1.7 g of a 10% solution of TX-100 (Rohm and Haas) while mixing under low shear. The resulting Lippmann emulsion, referred to as Lippman emulsion E, was chill set at 5° C. and saved for melt preparation.

A photographic melt used in silver halide color photographic materials was prepared by combining 28.9 g of the ultraviolet ray absorbing dispersion A from Example 1, 34.1 g of Lippmann emulsion E, 5.3 g of a 35% Type IV gelatin, 28.5 g of water, 1.7 g of a magnesium sulfate solution and 1.5 g of a sodium hydroxide solution. The resulting melt was heated to 45° C. and held for 7 hours under low shear mixing. The resulting photographic melt is referred to as melt E.

EXAMPLE 6

A Lippmann emulsion from Example 1 was treated with a surface active agent by heating 32.4 g Lippmann emulsion to 45° C. and adding 1.7 g of a 10% solution of Dowfax 2A1 (Dow Chemical) while mixing under low shear. The resulting Lippmann emulsion, referred to as Lippmann emulsion F, was chill set at 5° C. and saved for melt preparation.

A photographic melt used in silver halide color photographic materials was prepared by combining 28.9 g of the ultraviolet ray absorbing dispersion A from Example 1, 34.1 g of Lippmann emulsion F, 5.3 g of a 35% Type IV gelatin, 28.5 g of water, 1.7 g of a magnesium sulfate solution and 1.5 g of a sodium hydroxide solution. The resulting melt was heated to 45° C. and held for 7 hours under low shear mixing. The resulting photographic melt is referred to as melt F.

EXAMPLE 7

A Lippmann emulsion from Example 1 was treated with a surface active agent by heating 32.4 g Lippmann emulsion to 45° C. and adding 1.7 g of a 10% solution of Alkanol XC (Dupont) while mixing under low shear. The resulting Lippmann emulsion, referred to as Lippmann emulsion G, was chill set at 5° C. and saved for melt preparation.

A photographic melt used in silver halide color photographic materials was prepared by combining 28.9 g of the ultraviolet ray absorbing dispersion A from Example 1, 34.1 g of Lippmann emulsion G, 5.3 g of a 35% Type IV gelatin, 28.5 g of water 1.7 g of a magnesium sulfate solution and 1.5 g of a sodium hydroxide solution. The resulting melt was heated to 45° C. and held for 7 hours under low shear mixing. The resulting photographic melt is referred to as melt G.

EXAMPLE 8

A photographic melt used in silver halide color photographic materials was prepared by combining 28.9 g of the ultraviolet ray absorbing dispersion A from Example 1, 12.4 g of a 35% Type IV gelatin, 55.5 g of water, 1.7 g of a magnesium sulfate solution and 1.5 g of a sodium hydroxide solution. The resulting melt was heated to 45° C. and held for 7 hours under low shear mixing. The resulting photographic melt is referred to as melt H.

EXAMPLE 9

An ultraviolet ray absorbing dispersion was prepared in the following way: 75.0 g of Type IV gelatin, together with 92 g of a 10% aqueous solution of Alkanol XC (Dupont), was dissolved in 683 g of water at 50° C. 75.0 g of anisylidene-n-propylcyanoacetate was dissolved in 75.0 g of 1,4-cyclohexylenedimethylene bis(2-ethylhexanaoate) and added to the aqueous gelatin solution. The resulting mixture was pre-mixed for 2 minutes using a Tekmar high shear mixer and and passed through a Crepaco homogenizer one time at 3500 psi. The resulting dispersion, denoted as dispersion B, was chill set at 5° C. and stored for melt preparation.

An ultraviolet ray absorbing dispersion was prepared in the following way: 75.0 g of Type IV gelatin, together with 92 g of a 10% aqueous solution of Alkanol XC (Dupont), was dissolved in 683 g of water at 50° C. 75 g of 3-di-n-hexylaminoallylidene-malonitrile was dissolved in 75 g of 1,4-cyclohexylenedimethylene bis(2-ethylhexanaoate) and added to the aqueous gelatin solution. The resulting mixture was pre-mixed for 2 minutes using a Tekmar high shear mixer and and passed through a Crepaco homogenizer one time at 3500 psi. The resulting dispersion, denoted as dispersion C, was chill set at 5° C. and stored for melt preparation.

A photographic melt used in silver halide color photographic materials was prepared by combining 14.5 g of the ultraviolet ray absorbing dispersion B, 14.5 g of the ultraviolet ray absorbing dispersion C, 32.4 g of a 14% Lippmann emulsion, having an average equivalent spherical diameter of 0.05 microns, dispersed in gelatin, 7.4 g of a 35% Type IV gelatin, 28.0 g of water, 1.7 g of a magnesium sulfate solution and 1.5 g of a sodium hydroxide solution. The resulting melt was heated to 45° C. and held for 7 hours under low shear mixing. The resulting photographic melt is referred to as melt 1.

EXAMPLE 10

A Lippmann emulsion from Example 1 was treated with a surface active agent by heating 32.4 g Lippmann emulsion to 45° C. and adding 0.7 g of a 10% solution of Alkanol XC (Dupont) while mixing under low shear. The resulting Lippmann emulsion, referred to as Lippmann emulsion H, was chill set at 5° C. and saved for melt preparation.

A photographic melt used in silver halide color photographic materials was prepared by combining 14.5 g of the ultraviolet ray absorbing dispersion B from Example 9, 14.5 g of the ultraviolet ray absorbing dispersion C from Example 9, 33.1 g of Lippmann emulsion H, 7.4 g of a 35% Type IV gelatin, 27.3 g of water 1.7 g of a magnesium sulfate solution and 1.5 g of a sodium hydroxide solution. The resulting melt was heated to 45° C. and held for 7 hours under low shear mixing. The resulting photographic melt is referred to as melt J.

EXAMPLE 11

An ultraviolet ray absorbing dispersion was prepared in the following way: 75 g of Type IV gelatin, together with 180 g of a 10% aqueous solution of Alkanol XC (Dupont), was dissolved in 1395.7 g of water at 50° C. 75 of anisylidene-n-propylcyanoacetate, 75 g of 3-di-n-hexylaminoallylidene-malonitrile, and 15 g of Irganox 1076 was dissolved in 105 g of triethylhexyl phosphate and added to the aqueous gelatin solution. The resulting mixture was pre-mixed for 2 minutes using a Tekmar high shear mixer and passed through a Crepaco homogenizer one time at 5000 psi. The resulting dispersion, denoted as dispersion D, was chill set at 5° C. and stored for melt preparation.

A photographic melt used in silver halide color photographic materials was prepared by combining 28.9 g of the ultraviolet ray absorbing dispersion E, 32.4 g of a 14% Lippmann emulsion, having an average equivalent spherical diameter of 0.05 microns, dispersed in gelatin, 7.4 g of a 35% Type IV gelatin, 28.1 g of water, 1.7 g of a magnesium sulfate solution and 1.5 g of a sodium hydroxide solution. The resulting melt was heated to 45° C. and held for 7 hours under low shear mixing. The resulting photographic melt is referred to as melt K.

EXAMPLE 12

A Lippmann emulsion from Example 1 was treated with a surface active agent by heating 32.4 g Lippmann emulsion to 45° C. and adding 0.8 g of a 10% solution of Alkanol XC (Dupont) while mixing under low shear. The resulting Lippmann emulsion, referred to as Lippmann emulsion I, was chill set at 5° C. and saved for melt preparation.

A photographic melt used in silver halide color photographic materials was prepared by combining 28.9 g of the ultraviolet ray absorbing dispersion D, 33.2 g of Lippmann emulsion I, having an average equivalent spherical diameter of 0.05 microns, dispersed in gelatin, 7.4 g of a 35% Type IV gelatin, 27.3 g of water, 1.7 g of a magnesium sulfate solution and 1.5 g of a sodium hydroxide solution. The resulting melt was heated to 45° C. and held for 7 hours under low shear mixing. The resulting photographic melt is referred to as melt L.

EXAMPLE 13

An ultraviolet ray absorbing polymer particle was prepared in the following ratios: 60.0 g of Type IV gelatin, together with 15.0 g of a 10% aqueous solution of Alkanol XC (Dupont), was dissolved in 511.4 g of water at 50° C. To the aqueous composition was added 355.3 g of a 30% solids polyethylmethacrylate latex and the resulting solution was heated to 50° C. 27.9 g of anisylidene-n-propylcyanoacetate and 25.4 g of 3-di-n-hexylaminoallylidene-malonitrile were heated to 75° C. The UV absorber dye mixture was pre-mixed for 2 minutes using a Tekmar high shear mixer into the gelatin phase and passed through a Crepaco homogenizer one time at 5000 psi. The resulting dispersion, denoted as dispersion F.

A photographic melt used in silver halide color photographic materials was prepared by combining 122.3 g of the ultraviolet ray absorbing dispersion F, 87.2 g of a 14% Lippmann emulsion, having an average equivalent spherical diameter of 0.05 microns, dispersed in gelatin, 40.6 g of a 35% Type IV gelatin, 87.3 g of water, 9.0 g of a magnesium sulfate solution. The resulting melt was heated to 45° C. and pH adjusted with sodium hydroxide to 5.8 held for 24 hours under low shear mixing. The resulting photographic melt is referred to as melt M.

EXAMPLE 14

A photographic melt used in silver halide color photographic materials was prepared by combining 87.2 g of a 14% Lippmann emulsion, having an average equivalent spherical diameter of 0.05 microns, dispersed in gelatin, 40.6 g of a 35% Type IV gelatin and 74.0 g of water and heating to 45° C. To this solution was added 7.0 g of a 10% solution of Alkanol XC surfactant and the solution was allowed to stir for 30 minutes. Next, 122.3 g of the ultraviolet ray absorbing dispersion F and 9.0 g of a magnesium sulfate solution were added to the melt and pH adjusted with sodium hydroxide to 5.8 and held for 24 hours at 45° C. under low shear mixing. The resulting photographic melt is referred to as melt N.

EXAMPLE 15

An ultraviolet ray absorbing polymer particle was prepared in the following ratios: 60.0 g of Type IV gelatin, together with 15.0 g of a 10% aqueous solution of Alkanol XC (Dupont), was dissolved in 670 g of water at 50° C. To the aqueous composition was added 200 g of a 40% solids polyurethane (Neorez R-9699) polyurethane latex and the resulting solution was heated to 50° C. 27.9 g of anisylidene-n-propylcyanoacetate and 25.4 g of 3-di-n-hexylaminoallylidene-malonitrile were heated to 75° C. The UV absorber dye mixture was pre-mixed for 2 minutes using a Tekmar high shear mixer into the gelatin phase and passed through a Microfluidizer homogenizer 3 times at 3000 psi. The resulting dispersion, denoted as dispersion G.

A photographic melt used in silver halide color photographic materials was prepared by combining 147.2 g of the ultraviolet ray absorbing dispersion G, 104.9 g of a 14% Lippmann emulsion, having an average equivalent spherical diameter of 0.05 microns, dispersed in gelatin, 31.2 g of a 35% Type IV gelatin, 48.3 g of water, 8.8 g of a magnesium sulfate solution. The resulting melt was heated to 45° C. and pH adjusted with sodium hydroxide to 5.8 held for 24 hours under low shear mixing. The resulting photographic melt is referred to as melt O.

EXAMPLE 16

A photographic melt used in silver halide color photographic materials was prepared by combining 104.9 g of a 14% Lippmann emulsion, having an average equivalent spherical diameter of 0.05 microns, dispersed in gelatin, 31.2 g of a 35% Type IV gelatin and 40.7 g of water and heating to 45° C. To this solution was added 7.0 g of a 10% solution of Alkanol XC surfactant and the solution was allowed to stir for 30 minutes. Next, 147.2 g of the ultraviolet ray absorbing dispersion G and 8.8 g of a magnesium sulfate solution were added to the melt and pH adjusted with sodium hydroxide to 5.8 and held for 24 hours at 45° C. under low shear mixing. The resulting photographic melt is referred to as melt P.

The quality of the resulting melts from Examples 1 thru 16 were tested by measuring the number of particles per gram of melt larger than 2.8 microns and 5 microns in size using a Coulter Counter Technique. Table 1 shows the results.

TABLE 1

| | | Coating Solution Quality | |
|---|---|---|---|
| | | Greater than 2.8 microns | Greater than 5.0 microns |
| Example 1 (Comparison) | Lippmann (No added surfactant) | $1.3 \times 10^6$ | $7.2 \times 10^5$ |
| Example 2 (Invention) | Lippmann (TX-200 added) | $4.5 \times 10^4$ | $3.2 \times 10^3$ |

TABLE 1-continued

| | | Coating Solution Quality | |
|---|---|---|---|
| | | Greater than 2.8 microns | Greater than 5.0 microns |
| Example 3 (Invention) | Lippmann (SDS added) | $2.1 \times 10^4$ | $1.4 \times 10^3$ |
| Example 4 (Invention) | Lippmann (Olin 10G added) | $6.2 \times 10^4$ | $1.1 \times 10^4$ |
| Example 5 (Invention) | Lippmann (TX-100 added) | $6.1 \times 10^5$ | $1.5 \times 10^5$ |
| Example 6 (Invention) | Lippmann (Dowfax 2A1 added) | $6.7 \times 10^5$ | $9.1 \times 10^4$ |
| Example 7 (Invention) | Lippmann (Alkanol XC added) | $1.0 \times 10^5$ | $1.9 \times 10^4$ |
| Example 8 (Comparison) | No Lippmann | $1.8 \times 10^4$ | $8.4 \times 10^2$ |
| Example 9 (Comparison) | Lippmann (No added surfactant) | $1.3 \times 10^6$ | $7.2 \times 10^5$ |
| Example 10 (Invention) | Lippmann (Alkanol XC added) | $1.7 \times 10^5$ | $1.2 \times 10^4$ |
| Example 11 (Comparison) | Lippmann (No added surfactant) | $3.3 \times 10^5$ | $3.9 \times 10^4$ |
| Example 12 (Invention) | Lippmann (Alkanol XC added) | $4.8 \times 10^4$ | $1.3 \times 10^4$ |
| Example 13 (Comparison) | Lippmann (No added surfactant) | $5.1 \times 10^5$ | $2.1 \times 10^4$ |
| Example 14 (Invention) | Lippmann (Alkanol XC added) | $1.0 \times 10^5$ | $1.0 \times 10^4$ |
| Example 15 (Comparison) | Lippmann (No surfactant added) | $1.2 \times 10^6$ | $1.6 \times 10^5$ |
| Example 16 (Invention) | Lippmann (Alkanol XC added) | $2.4 \times 10^5$ | $3.9 \times 10^4$ |

Table 1 demonstrates that large oil droplet formation in coating solutions which contain an ultraviolet ray absorbing dispersion and a Lippmann emulsion can be greatly suppressed when the Lippmann emulsion is presaturated with a surfactant prior to contact with the ultraviolet ray absorber dispersion.

The invention has been described in detail with particular reference to certain preferred embodiments thereof, but it will be understood that variations and modifications can be effected within the spirit and scope of the invention.

What is claimed is:

1. A method for stabilizing a photographic coating melt comprising an aqueous medium having a dispersed liquid organic phase, an ultraviolet ray absorber compound and an emulsion containing silver halide particles having an average equivalent circular diameter of from 0.03 to 0.10 microns wherein the ultraviolet ray absorber compound is soluble in the dispersed liquid organic phase and substantially insoluble in water, said method comprising:

adding to said emulsion containing silver halide particles a sufficient amount of surfactant prior to adding said emulsion to said aqueous medium and said dispersed liquid organic phase to passify surfaces of the silver halide particles.

2. A photographic element made by the method of claim 1.

3. The method of claim 1, wherein said surfactant is selected from the group consisting of sulfonates of napthalene, sulfo-succinimates, sulfosuccinates, sulfates and sulfonates of ethoxylated alcohols, ethoxylated alkyl phenols, diphenyl sulfonate derivatives and polyglycidols.

4. The method of claim 1, wherein said liquid organic phase comprises an organic solvent selected from the group consisting of di ethyl phthalate, di butyl phthalate, di pentyl phthalate, di isoamyl phthalate, di benzyl phthalate, dimethoxyethyl phthalate, di butoxyethyl phthalate, acetyl tributyl citrate, tributyl citrate, triethyl citrate, di methyl sebacate, di ethyl sebacate, 1,4-cyclohexylenedimethylene bis(2-ethylhexanaoate), bis-ethylhexyl sulfoxide, triphenylphosphate, tricresylphosphate, trihexylphosphate, n-Hexylphenylcarbinol, 2-(p-tert, butylphenoxy)-ethanol, Acetyl n-butyl aniline, N-n-amyl succinimide, N,N-di-propyl dodecanamide, di-tert amyl phenol, phenoxy toluene, ethylhexyl hydroxy benzoate, ethylhexyltoluene sulfonamide, undecyl alcohol, butyl methoxy benzoate, butyl phthalylbutyl glycollate, and N,N'-di-n-butyl urea, hexadecane, bis (2-ethylhexyl)azelate, tri (2-ethylhexyl) phosphate, trioctylphosphine oxide, dinonyl phthalate, didecyl phthalate, didodecyl phthalate, 3-(4-hydroxy-3,5-di-t-butylphenyl)propionic acid octadecyl ester, and trioctyl amine.

5. The method of claim 1, wherein the ultraviolet ray absorbing compound is represented by formula I:

(I)

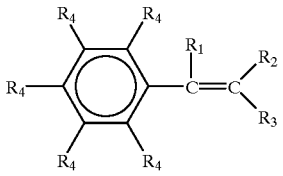

wherein $R_4$ is each independently selected from the group consisting of hydrogen, halogen, alkyl, aryl group having from 6 to 20 carbon atoms, alkoxy group, aryloxy, alkylthio group, arylthio group, amine group, cyano group, nitro group, acylamino group, sulfonyl group, sulfoamido group, acyloxy group, oxycarbonyl group, or two neighboring $R_4$ groups may form a 5- or 6- member ring by ring closure; $R_1$ represents a hydrogen atom, or an alkyl group; $R_2$ or $R_3$ each represents a cyano group, —$COOR_9$, —CO—$NHR_9$, —$SO_2R_9$, CO—$R_9$, where $R_9$ represents an alkyl group, and an aryl group.

6. The method of claim 1, wherein the ultraviolet ray absorbing compound is represented by formula II:

(II)

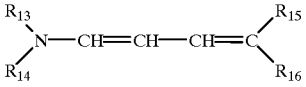

where $R_{13}$, and $R_{14}$, which may be the same or different, each represents a hydrogen atom, an alkyl group, an aryl group, $R_{15}$ and $R_{16}$ each represents a cyano group, —$COOR_{17}$, $COR_{17}$, or $SO_2R_{17}$, where $R_{17}$ represents alkyl group, or an aryl group.

7. The method of claim 1 wherein the ultraviolet ray absorber compound is contained in a polymer particle.

8. The method of claim 7 wherein the polymer particle comprises polymerized monomers selected from the group consisting of esters derived from an acrylic acid, amides derived from an acrylic acid, vinyl esters, a vinyl ethers, styrenics, esters of maleic acid, N-vinyl-2-pyrrolidone, vinyl chloride, vinylidene chloride and vinyl pyridine.

9. The method of claim 7 wherein the polymer particle comprises a polyurethane.

10. A method of preparing a photographic coating melt comprising:

preparing a dispersion of an aqueous medium, a dispersed liquid organic phase and an ultraviolet ray absorber compound wherein the ultraviolet ray absorber compound is soluble in the dispersed liquid organic phase and substantially insoluble in water;

preparing an emulsion containing silver halide particles having an average equivalent circular diameter of from 0.03 to 0.10 microns:

adding to said emulsion containing silver halide particles a sufficient amount of surfactant to passify surfaces of the silver halide particles; and combining said dispersion and said emulsion to form the photographic coating melt.

11. The method of claim 10, wherein said surfactant is selected from the group consisting of sulfonates of napthalene, sulfo-succinimates, sulfosuccinates, sulfates and sulfonates of ethoxylated alcohols, ethoxylated alkyl phenols, diphenyl sulfonate derivatives and polyglycidols.

12. The method of claim 10, wherein said dispersed liquid organic phase comprises an organic solvent selected from the group consisting of di ethyl phthalate, di butyl phthalate, di pentyl phthalate, di isoamyl phthalate, di benzyl phthalate, di- methoxyethyl phthalate, di butoxyethyl phthalate, acetyl tributyl citrate, tributyl citrate, triethyl citrate, di methyl sebacate, di ethyl sebacate, 1,4-cyclohexylenedimethylene bis(2-ethylhexanaoate), bis-ethylhexyl sulfoxide, triphenylphosphate, tricresylphosphate, trihexylphosphate, n-Hexylphenylcarbinol, 2-(p-tert, butylphenoxy)-ethanol, Acetyl n-butyl aniline, N-n-amyl succinimide, N,N-di-propyl dodecanamide, di-tert amyl phenol, phenoxy toluene, ethylhexyl hydroxy benzoate, ethylhexyltoluene sulfonamide, undecyl alcohol, butyl methoxy benzoate, butyl phthalylbutyl glycollate, and N,N'-di-n-butyl urea, hexadecane, bis (2-ethylhexyl)azelate, tri (2-ethylhexyl) phosphate, trioctylphosphine oxide, dinonyl phthalate, didecyl phthalate, didodecyl phthalate, 3-(4-hydroxy-3,5-di-t-butylphenyl)propionic acid octadecyl ester, and trioctyl amine.

13. The method of claim 10, wherein the ultraviolet ray absorbing compound is represented by formula I:

(I)

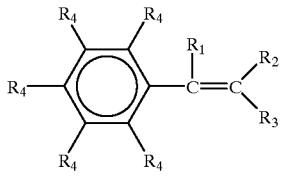

wherein $R_4$ is each independently selected from the group consisting of hydrogen, halogen, alkyl, aryl group having from 6 to 20 carbon atoms, alkoxy group, aryloxy, alkylthio group, arylthio group, amine group, cyano group, nitro group, acylamino group, sulfonyl group, sulfoamido group, acyloxy group, oxycarbonyl group, or two neighboring $R_4$ groups may form a 5- or 6- member ring by ring closure; $R_1$ represents a hydrogen atom, or an alkyl group; $R_2$ or $R_3$ each represents a cyano group, —$COOR_9$, —CO—$NHR_9$, —$SO_2R_9$, CO—$R_9$, where $R_9$ represents an alkyl group, and an aryl group.

14. The method of claim 10, wherein the ultraviolet ray absorbing compound is represented by formula II:

(II)

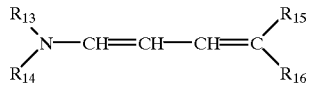

where $R_{13}$, and $R_{14}$, which may be the same or different, each represents a hydrogen atom, an alkyl group, an aryl group, $R_{15}$ and $R_{16}$ each represents a cyano group, —$COOR_{17}$, $COR_{17}$, or $SO_2R_{17}$, where $R_{17}$ represents alkyl group, or an aryl group.

15. The method of claim 10 wherein the ultraviolet ray absorber compound is contained in a polymer particle.

16. The method of claim 15 wherein the polymer particle comprises polymerized monomers selected from the group consisting of esters derived from an acrylic acid, amides derived from an acrylic acid, vinyl esters, a vinyl ethers, styrenics, esters of maleic acid, N-vinyl-2-pyrrolidone, vinyl chloride, vinylidene chloride and vinyl pyridine.

17. The method of claim 15 wherein the polymer particle comprises a polyurethane.

18. A method for stabilizing a photographic coating melt comprising an aqueous medium having, a dispersed liquid organic phase, an ultraviolet ray absorber compound contained in a polymer particle and an emulsion containing silver halide particles having an average equivalent circular diameter of from 0.03 to 0.10 microns wherein the ultraviolet ray absorber compound is soluble in the dispersed liquid organic phase and substantially insoluble in water, said method comprising:

adding to said emulsion containing silver halide particles a sufficient amount of surfactant to passify surfaces of the silver halide particles.

19. The method of claim 18 wherein the polymer particle comprises polymerized monomers selected from the group consisting of esters derived from an acrylic acid, amides derived from an acrylic acid, vinyl esters, a vinyl ethers, styrenics, esters of maleic acid, N-vinyl-2-pyrrolidone, vinyl chloride, vinylidene chloride and vinyl pyridine.

* * * * *